US008901458B2

(12) United States Patent
Aussi et al.

(10) Patent No.: US 8,901,458 B2
(45) Date of Patent: Dec. 2, 2014

(54) METHOD FOR AN ICE BUILDUP INHIBITOR

(71) Applicant: The Board of Regents of the University of Texas System, Austin, TX (US)

(72) Inventors: Yamen Aussi, San Antonio, TX (US); Pamela Long, Cibolo, TX (US); Micheal Nicolas, Olympia, WA (US); Daniel Vargas, San Antonio, TX (US)

(73) Assignee: Board of Regents of the University of Texas System, Austin, TX (US)

( * ) Notice: Subject to any disclaimer, the term of this patent is extended or adjusted under 35 U.S.C. 154(b) by 0 days.

(21) Appl. No.: 13/853,142

(22) Filed: Mar. 29, 2013

(65) Prior Publication Data

US 2013/0212975 A1 Aug. 22, 2013

Related U.S. Application Data

(63) Continuation of application No. 12/901,302, filed on Oct. 8, 2010, now Pat. No. 8,476,558.

(60) Provisional application No. 61/250,202, filed on Oct. 9, 2009, provisional application No. 61/391,523, filed on Oct. 8, 2010.

(51) Int. Cl.

| | |
|---|---|
| ***H05B 3/00*** | (2006.01) |
| ***E04D 13/076*** | (2006.01) |
| *E04D 13/00* | (2006.01) |

(52) U.S. Cl.

CPC ..... *E04D 13/0762* (2013.01)
USPC ..... 219/213; 219/212; 52/11; 392/435

(58) Field of Classification Search

USPC ..... 219/212–13, 528, 544, 549; 52/11–15; 392/435

See application file for complete search history.

(56) References Cited

U.S. PATENT DOCUMENTS

| | | | | |
|---|---|---|---|---|
| 3,823,304 | A * | 7/1974 | Siemianowski | 219/213 |
| 6,297,475 | B2 | 10/2001 | Jones | |
| 6,700,098 | B1 | 3/2004 | Wyatt et al. | |
| 7,448,167 | B2 * | 11/2008 | Bachman | 52/12 |
| 2005/0166466 | A1 | 8/2005 | Cobb | |
| 2006/0032153 | A1 | 2/2006 | Wodicka | |

* cited by examiner

*Primary Examiner* — Shawntina Fuqua
(74) *Attorney, Agent, or Firm* — Jackson Walker, LLP

(57) ABSTRACT

An ice buildup inhibitor is disclosed useful for preventing ice damming, in particular in conjunction with the use of a closed gutter. Heat escape through a roof made warm snow pack, causing it to melt and flow down toward the gutter. After moving away from the heated roof, the water may re-freeze and form an ice dam. In the ice buildup inhibitor may be configured to warm in the closed gutter, thereby preventing the formation of an ice dam. They ice buildup inhibitor may be configured to be easily installed onto an existing closed gutter, enabling responsive installation on only those homes experiencing ice damming.

5 Claims, 5 Drawing Sheets

METHOD FOR AN ICE BUILDUP INHIBITOR

CROSS REFERENCE TO RELATED APPLICATIONS

This continuation application claims priority to U.S. application Ser. No. 12/901,102, filed Oct. 8, 2010, entitled "Ice Buildup Inhibitor," which claims priority to U.S. Provisional Application 61/250,202, filed Oct. 9, 2009 and entitled "ICE GUARD TO A PRACTICAL AND ECONOMICAL SOLUTION TO ALLEVIATE ICE BUILDUP ON CLOSED GUTTER SYSTEMS." The foregoing is incorporated herein by reference. The application also claims priority to U.S. Provisional Application 61/391,523, filed Oct. 8, 2010, entitled "ICE GUARD," which is incorporated herein by reference.

BACKGROUND

This specification to the field of weather response systems, and more particularly to a device and system for preventing the "ice damming" and dangerous icicles on structures such as homes and offices.

Structures located in regions that experience cold weather, including ice and snow, may have problems with "ice damming." Ice damming occurs when snow or ice pack is partially melted by heat escape through a roof. The melted ice may flow down the relatively warm roof, and then re-accumulate as ice along unheated eaves. The accumulated ice forms a dam that can trap melted water and cause icicles. Another issue related to ice damming is its unpredictability. It may be difficult to tell between the two nearly identical homes which will experience ice damming and which will not.

One prior art solution to ice damming is the use of conductive heating cables.

SUMMARY OF THE INVENTION

In one aspect, an ice buildup inhibitor is disclosed useful for preventing ice damming, in particular in conjunction with the use of a closed gutter. Heat escape through a roof made warm snow pack, causing it to melt and flow down toward the gutter. After moving away from the heated roof, the water may re-freeze and form an ice dam. In the ice buildup inhibitor may be configured to warm in the closed gutter, thereby preventing the formation of an ice dam. They ice buildup inhibitor may be configured to be easily installed onto an existing closed gutter, enabling responsive installation on only those homes experiencing ice damming.

DETAILED DESCRIPTION OF THE EMBODIMENTS

An ice buildup inhibitor is provided to prevent ice damming, for example as may occur in connection with the use of closed gutter systems.

An ice buildup inhibitor will now be described with more particular reference to the attached drawings. Hereafter, details are set forth by way of example to facilitate discussion of the disclosed subject matter. It should be apparent to a person of ordinary skill in the field, however, that the disclosed embodiments are exemplary and not exhaustive of all possible embodiments.

Figure 1:
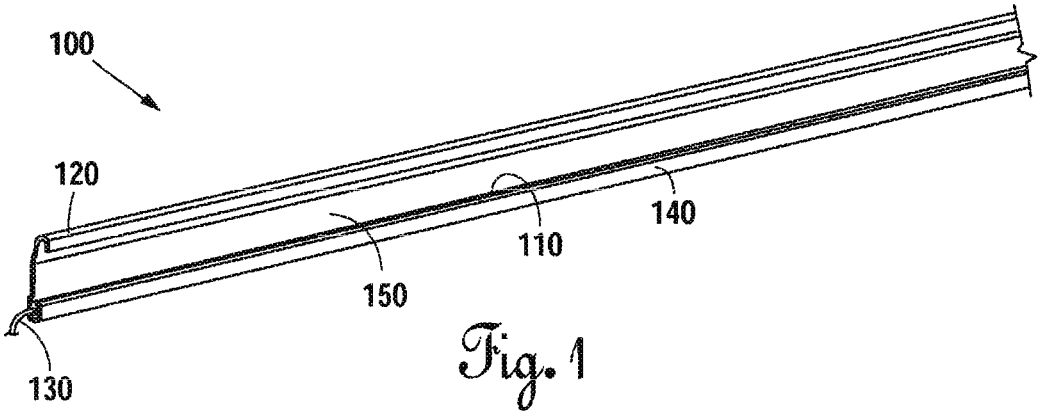
FIG. 1 is a perspective view of an ice buildup inhibitor.
Figure 2:
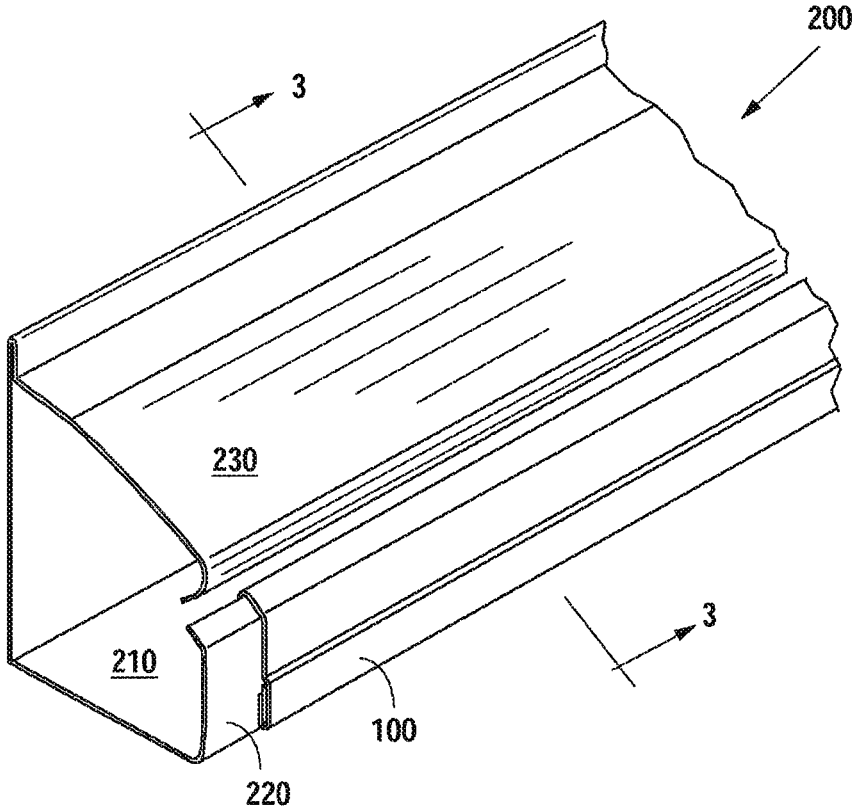
FIG. 2 is a perspective view of an ice buildup inhibitor in situ with a closed gutter.

FIG. 1 is a perspective view of an exemplary embodiment of an ice buildup inhibitor 100. In this exemplary embodiment, ice buildup inhibitor 100 includes a support substrate 130, which provides a structural foundation. Molded onto support substrate 130 is a mounting hook 120. Mounting hook 120 is a continuous hooked lip configured to engage a forward guard 220 (FIG. 2) of a closed gutter 200 (FIG. 2). Also molded into support substrate 130 is a heat strip holder 140, which is configured to receive and at least partially enclose a heat strip 110. Heat strip 110 may be, for example, a self-regulated heating cable, such as those provided by Raychem. The heat strip may comprise two parallel conductors embedded in a heating core, typically made of conductive polymer. The core is radiation cross linked to ensure long-term reliability. As the temperature drops, the number of electrical paths through the core increases and more heat is produced. Conversely, as the temperature rises the core has fewer electrical paths and less heat is produced. Power is supplied to heat strip 110 by a power cord 130.

Furthermore, although a purely electrical heat strip is disclosed herein, those having skill in the art will recognize that other species of heat strips may be substituted, such as a chemically-activated heat strip, or an electromechanical heat strip.

An exemplary method of manufacturing a support substrate 130 includes cutting a strip of sheets of aluminum approximately 2 inches wide and 10 feet long. The aluminum may be, for example, 0.032-inch thickness 3105 H24 aluminum alloy. The aluminum strip can then be bent to form mounting hook 120 and heat strip holder 140. A second exemplary method of forming support substrate 130 includes extruding the aluminum in the proper shape up to a length of approximately 10 feet. A 2-inch width and 10 foot length are disclosed as exemplary dimensions, but those having skill in the art will appreciate that alternative dimensions can be easily substituted. Those having skill in the art will also easily appreciate that the gauge of sheet aluminum can be widely varied. Once support substrate is properly formed, it may be painted to match known colors of closed gutters 200 (FIG. 2) for added attractiveness. The following table provides exemplary equipment configurations:

| Operation | Machine Type | Tooling |
|---|---|---|
| Cut to length/bend | CNC miter saw | — |
| Paint | Paint booth | Paint sprayer |

FIG. 2 is a perspective view of an exemplary ice buildup inhibitor 100 installed in situ on an exemplary closed gutter 200. In an exemplary embodiment, closed gutter 200 is constructed of heat conductive aluminum. Alternatively, closed gutter may be constructed of other metals, vinyl, or other rigid or semirigid materials. Note however that if closed gutter 200 is constructed of a non-heat conductive material, the effectiveness of ice buildup inhibitor 100 may be reduced. An exemplary commercially available closed 200 is the Englert LeafGuard gutter, which is a seamless and continuous gutter, made of roll formed 0.032-inch 3105-H24 aluminum alloy, and installed with plastic brackets every 2 feet. The curved surface of the leaf card gutter sheds leaves and debris, and draws water into the conduit 210. The narrow opening between forward guard 220 and top guard 320 helps to keep out birds and squirrels.

Closed gutter 200 includes a waterflow conduit 210, which is configured to permit free flow of water under normal conditions. A forward guard 220 helps to define the shape of waterflow conduit 210 and to prevent leaves and other debris from entering from the front side. A top guard 230 is also provided, and is configured to help prevent leaves and other debris from entering from the top. Ice buildup inhibitor 100 is installed lengthwise along the forward guard 220.

Figure 8:
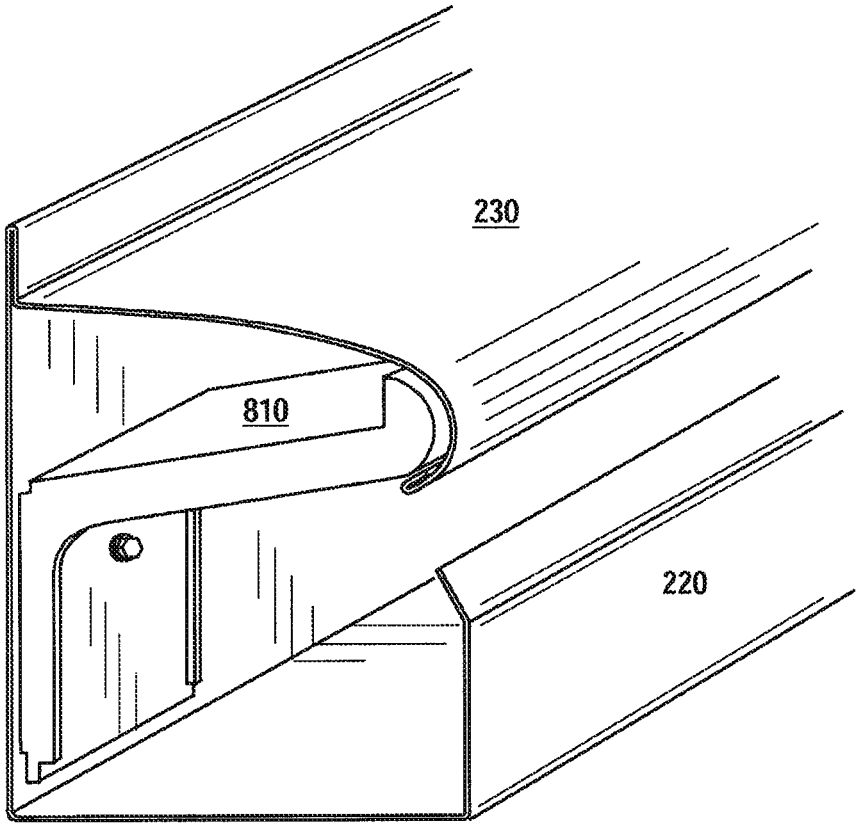
FIG. 8 is a second exemplary embodiment of a closed gutter further including a corrosion resistant bracket.

FIG. 8 discloses a second exemplary embodiment of a close gutter 200, representing an older design of a Leaf Guard gutter. This exemplary embodiment includes a corrosion resistant bracket 810, which helps to support top guard 230.

Alternatively, ice inhibitor 100 may be installed in other locations. For example, ice inhibitor 100 may be installed along waterflow conduit 210. In some cases, installation along forward guard 220 may be preferable to installation along waterflow conduit 210, as installation along waterflow conduit 210 may inhibit the free flow of water in the closed gutter. Also alternatively, other types of heat strips 110 may be used. For example, a self adhesive aluminum heat strip is known in the art. The durability of a self adhesive solution may be reduced, as accumulation of moisture may reduce the integrity of the self adhesion property.

An exemplary method of installing an ice buildup inhibitor 100 on a closed gutter 200 comprises the following steps:

Ensuring that closed gutter 200 is clean and dry.

Attaching ice buildup inhibitor 100 to forward guard 220 via mounting hook 120, for example by hooking mounting hook 120 over the lip of forward guard 220, or slidingly engaging in mounting hook 120 to forward guard 220.

Plugging power cord 130 into a suitable outdoor GFCI power outlet.

Optionally, attaching an automated control system.

The ease of the installation method disclosed above means that an ice buildup inhibitor 100 can be responsively installed on homes that experience ice damming. This can be advantageous, as it may be unclear which homes will experience heat escape and thereby develop ice damming problems.

Figure 3:
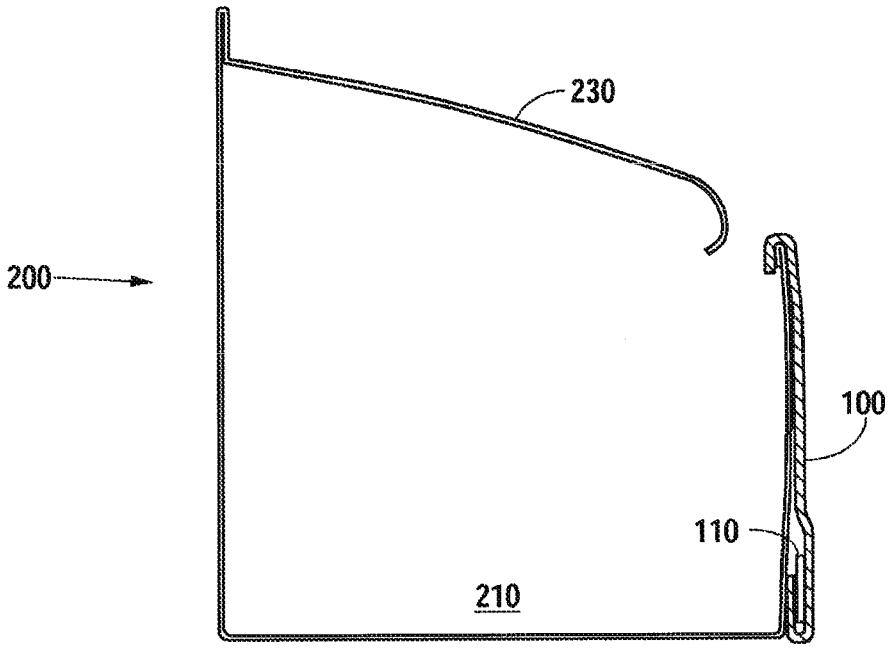
FIG. 3 is a cutaway view of the ice buildup inhibitor and closed gutter of FIG. 2.

FIG. 3 is a cutaway view of the installation of FIG. 2. This cutaway view more particularly discloses the shape of closed gutter 200, including top guard 230, waterflow conduit 210, and forward guard 220. This cutaway view also more particularly discloses how ice buildup inhibitor 100 is configured it to engage forward guard 220, and to receive heat strip 110.

Figure 4:
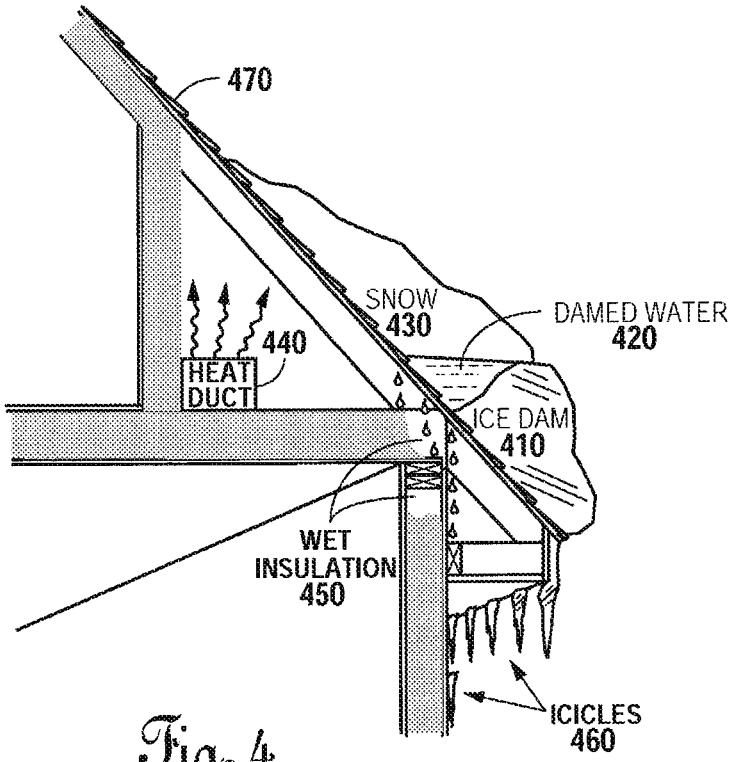
FIG. 4 is a cutaway view of a structure experiencing ice damming.

FIG. 4 is a cutaway view of an exemplary restructure suffering from ice damming. In this exemplary restructure, a heat duct 440 and other sources of heat leak onto roof 470. Snow for 30 has fallen on roof 470 and the heating of roof 470 causes some of the snow for 30 to melt. As they pulled water flows down onto an unheated eave 480, the water refreeze and forms an ice dam 410. Ice dam 410 traps dammed water 420 on the roof. This can cause various problems, including icicles 460, wet insulation 450, and damage to roof 470. Furthermore, in some cases, icicles 460 can grow extremely large and may prevent a safety hazard.

Figure 5:
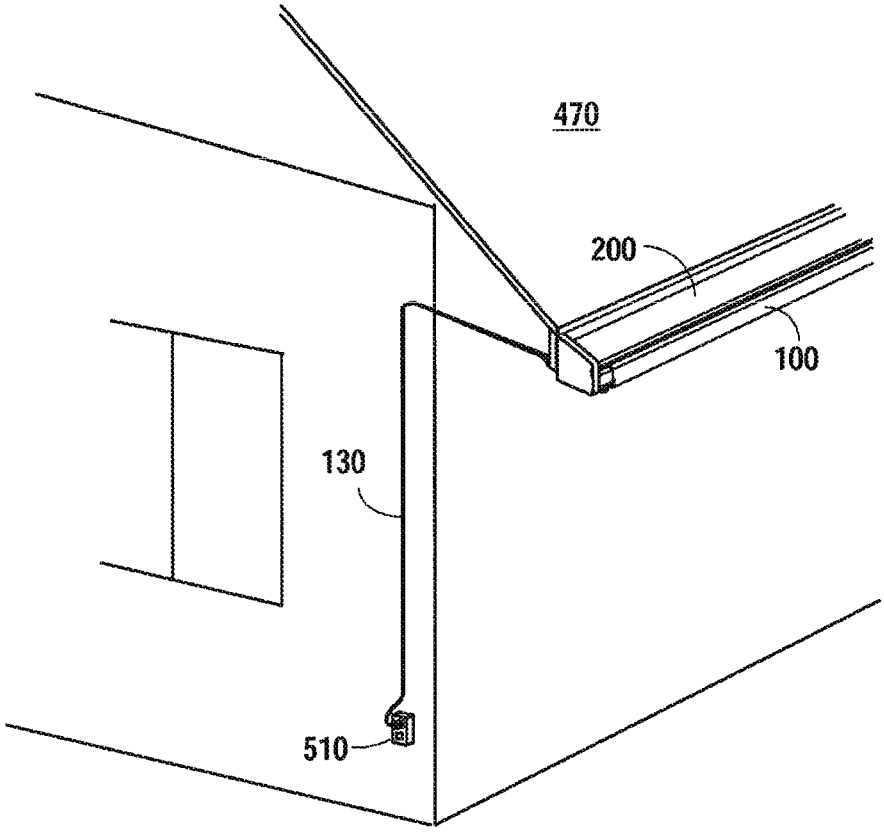
FIG. 5 is a perspective view of an ice buildup inhibitor and closed gutter installed on a structure.

FIG. 5 is an exemplary embodiment of an installation of a closed gutter 200 and ice inhibitor 100 on a roof 470. In this exemplary embodiment, closed gutter 200 and ice buildup inhibitor 100 may be installed to prevent ice damming such as that shown in FIG. 4. In the exemplary embodiment, support substrate 130 and closed gutter 200 are constructed of aluminum. Aluminum is known in the art to be a conductor of heat. As heat strip 110 heats up, ice buildup inhibitor 100 and closed gutter 200 also heat up. Because closed gutter 200 is maintained above the freezing point of water, melted water does not refreeze upon making contact with closed gutter 200. Instead, the water stays in liquid form and drops harmlessly off the roof.

This In some cases, ice buildup inhibitor is 100 may not be installed along the entire length of closed gutter 200. Rather, 10 foot segments of ice buildup inhibitor is 100 may be installed over critical areas, such as over walkways or other high-traffic areas.

In this exemplary embodiment, ice buildup inhibitor 100 is controlled manually. When there is snowpack on the roof, or when ice damming has started, a user may plug power cord 130 inch power outlet 510, thus turning on ice buildup inhibitor 100. Those having skill in the art will also appreciate that other manual control methods can be substituted, for example a simple button, switch, or remote control can be used to control the power supply from power outlet 510 to heat strip 110. To minimize power wastage, it is preferable for the user to turn on the ice buildup inhibitor 100 only when it is snowing, or there is danger of ice damming. At other times, is preferable to turn ice buildup inhibitor 100 off.

Figure 6:
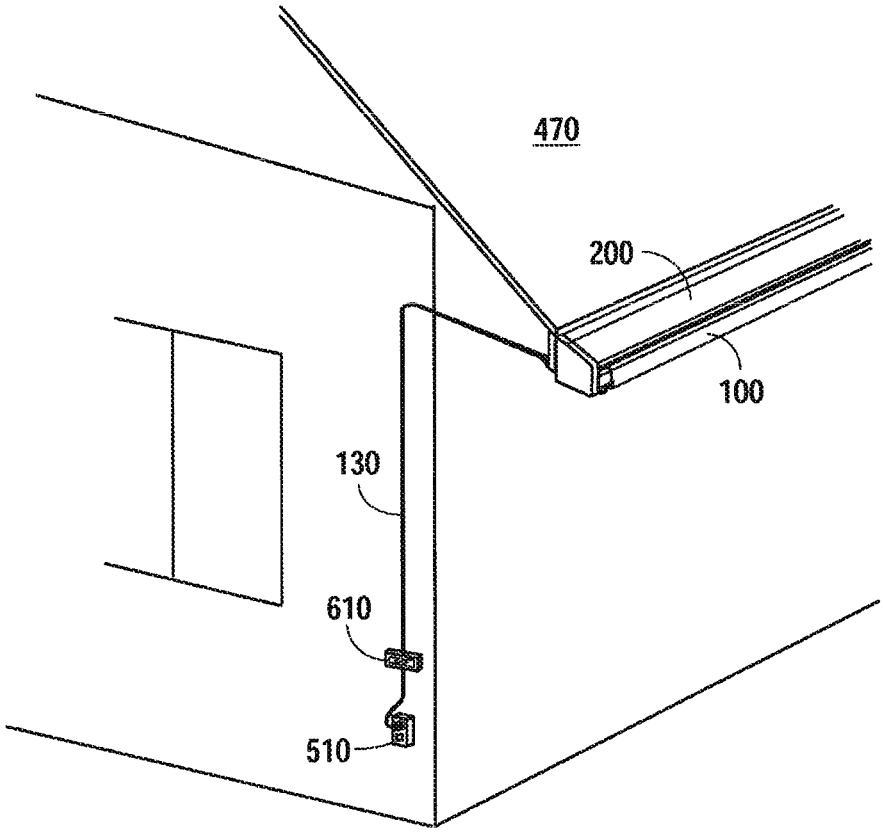
FIG. 6 is a perspective view of the installation of FIG. 5 with an automated control module.

FIG. 6 discloses a second exemplary installation of an ice buildup inhibitor 100. In this exemplary embodiment, an automated control module 610 is provided.

There are several options to consider for automated control module 610. For example, and ambient sensing controller has high performance, but in some embodiments may be expensive. Alternatively, automatic snow controllers also provide high-performance, but may be more economical than ambient sensing controllers. As a third exemplary embodiment, a self-regulating controller may be provided as a simple control method that varies its output as a surrounding temperature changes. The Raychem self-regulating heat strip discussed with respect to heat strip 110 is an example of a self-regulating controller. Note that automated control module 610 is a conceptual configuration in this drawing, and it may be represented either by a physical box as shown here, or maybe represented by a more integrated arrangement such as a self-regulating heat strip.

Exemplary sensors that may be used for control of ice buildup inhibitor 100 include the DSS-8 rain/snow controller and the CDP-2 snow sensor control/display panel.

Figure 7:
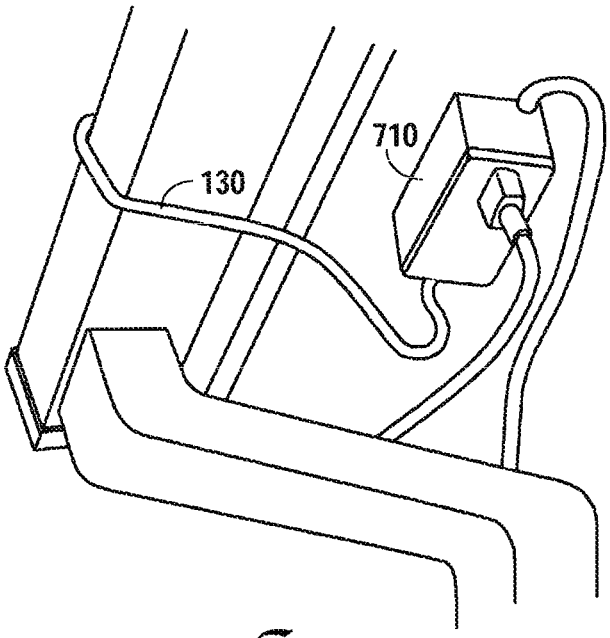
FIG. 7 is a perspective view of an ice buildup inhibitor with a continuous automated control module.

FIG. 7 discloses another alternative insulation embodiments where in a continuous automated control module 710 is used. An exemplary continuous automated control module 710 is the Easy Heat RS-2 Roof Sentry De-Icer Control, which is specifically designed specifically for controlling roof de-icing cables. The Roof Sentry can be installed under the roof eaves, and requires no further manual operation.

As an alternative to powering an ice buildup inhibitor 100 from a residential power supply, a solar power arrangement may be used. For example, a solar array may be connected to a rechargeable battery, which may then be connected to a power inverter to provide the appropriate power to ice buildup inhibitor 100. As an exemplary embodiment, a 90 amp-our battery may be used. An exemplary 80 W heating cable draws only 0.727 amps, which means that the ice buildup inhibitor

100 could be run for a total of 123.76 hours before the battery is completely drained and needs recharging.

Other exemplary methods of increasing the efficiency of an ice buildup inhibitor 100 are the use of a thermostat, ambient sensor, or insulation.

While the subject of this specification has been described in connection with one or more exemplary embodiments, it is not intended to limit the claims to the particular forms set forth. On the contrary, the appended claims are intended to cover such alternatives, modifications and equivalents as may be included within their spirit and scope.

What is claimed is:

1. A method of preventing ice damming along a roof gutter, the method comprising:

attaching an ice buildup inhibitor to a forward guard of the roof gutter, the ice buildup inhibitor including a support substrate and a heating strip, the forward guard having an upper edge, and the substrate configured to place the heat strip below the upper edge and adjacent a front wall of the forward guard; and providing power to the heat strip.

2. The method of claim 1 wherein providing power to the heat strip comprises plugging the heat strip into an alternating current power supply.

3. The method of claim 1 wherein providing power to the heat strip comprises providing solar power to the heat strip via a battery and inverter arrangement.

4. The method of claim 1 wherein providing power to the heat strip comprises providing an automated control module for controlling power based on ambient conditions.

5. An ice buildup inhibitor system comprising:

an aluminum closed gutter installed on the cave of a roof and constructed of seamless 0.032-inch thick 3105 H24 aluminum alloy, painted a first color, the gutter comprising:

a water flow conduit for high-flow water conduction;

a forward guard comprising an upper lip; and a top guard;

an ice buildup inhibitor constructed of seamless 0.032-inch thick 3105 H24 aluminum alloy, the ice buildup inhibitor comprising:

a support substrate providing mechanical support;

a mounting hook affixed to the support substrate and configured to removably engage the upper lip of the forward guard;

a self-regulating heat strip; and a heat strip holder affixed to the support substrate and configured to receive and at least partially enclose the heat strip;

wherein the substrate is configured to place the heat strip below the upper lip and adjacent a front wall of the forward guard; and a power supply line electrically connected to the heat strip;

a control system electrically connected to the power supply line and provided to selectively provide power to the supply line, the control system selected from the group consisting of a manual controller, and automated control module, and a continuous automated control module; and a power supply electrically connected to the control system and configured to make available power to the control system, the power supply selected from the group consisting of alternating current commercial power and battery-stored solar power.

* * * * *